United States Patent [19]

Kimura

[11] Patent Number: 4,976,024

[45] Date of Patent: Dec. 11, 1990

[54] METHOD OF AND APPARATUS FOR ROLLING DIRECTLY COUPLED WITH CONTINUOUS CASTING

[75] Inventor: Tomoaki Kimura, Hitachi, Japan

[73] Assignee: Hitachi, Ltd., Tokyo, Japan

[21] Appl. No.: 177,773

[22] Filed: Apr. 5, 1988

[30] Foreign Application Priority Data

Apr. 8, 1987 [JP] Japan ..... 62-84761

[51] Int. Cl.[5] ..... B23B 1/46; B23B 13/22; B22D 11/126

[52] U.S. Cl. ..... 29/527.6; 29/33 C; 29/527.7; 164/417; 164/476

[58] Field of Search ..... 29/527.6, 527.7, 33 C, 29/33 S; 164/476, 483, 417

[56] References Cited

U.S. PATENT DOCUMENTS 4,630,352 12/1986 Ginzburg et al. ..... 29/527.7
4,698,897 10/1987 Frommann et al. ..... 29/527.7

FOREIGN PATENT DOCUMENTS 372880 11/1983 Austria .
3443760 6/1986 Fed. Rep. of Germany .
56-144805 11/1981 Japan .
58-100903 6/1983 Japan ..... 29/527.7
58-100904 6/1983 Japan ..... 29/527.7
58-110161 6/1983 Japan .
58-218349 12/1983 Japan .
60-87903 5/1985 Japan .

*Primary Examiner*—Richard K. Seidel
*Assistant Examiner*—J. Reed Batten, Jr.
*Attorney, Agent, or Firm*—Fay, Sharpe, Beall, Fagan, Minnich & McKee

[57] ABSTRACT

A continuous casting machine is directly coupled to a rolling facility has many machines in a series including the rolling machine disposed downstream of the continuous casting machine. When one of the machines is stopped, the slab is still continuously produced by the continuous casting machine, but is sheared on the upstream side of the rolling machine and coiled in its hot state rather than rolled. Even though the rolling operation is interrupted, all of the slab being produced by the continuous casting machine is coiled so that the molten metal produced for the casting is not wasted. After the machine that has shut the line down is able to be restarted, the slab that has been stored in its hot state is uncoiled and supplied to the downstream machines.

6 Claims, 4 Drawing Sheets

METHOD OF AND APPARATUS FOR ROLLING DIRECTLY COUPLED WITH CONTINUOUS CASTING

BACKGROUND OF THE INVENTION

1. Field of the Invention

The present invention relates to a method of and an apparatus for rolling directly coupled with a continuous casting apparatus wherein a thin-slab continuous casting machine and a rolling machine are arranged in series and a slab produced by the continuous casting machine is directly rolled without being sheared.

2. State of the Related Art

As reported in Japanese Patent Unexamined Publication No. 60-87903, continuous casting-directly-coupled rolling facilities in which a continuous casting machine and a rolling machine are directly coupled with each other and a slab produced by the continuous casting machine is directly rolled without being sheared bring about large advantages in improving the production yield and energy saving.

With continuous casting-directly-coupled rolling facilities such as those disclosed in Japanese Patent Unexamined Publication No. 60-87903, a large number of machines, including a width rolling machine, a reduction rolling machine constituted by a multiplicity of stands, a cooling apparatus for a strip after reduction, a shearing machine, and a coiler for taking up final hot-rolled products, are arranged downstream of a continuous casting machine.

Frequently, there are cases where these machines disposed downstream of the continuous casting machine have to be shut down during an operation due to failures, such as a shortage of slabs during rolling or a failure in coiling.

In addition, if surface roughening occurs in a mill roll used in the rolling machine and rolling is continued with such a roll, harmful flaws are caused in the surface of the product which will be deprived of its commercial value, so that it is necessary to stop the rolling machine and replace the roll with a new one.

As described above, due to the situation of each machine being downstream and directly coupled with the continuous casting machine, cases can occur where the machines have to be stopped irrespective of the operating condition of the continuous casting machine. In such a case, since casting cannot be continued, the molten metal prepared for casting by the continuous casting machine is wasted.

In particular, with recent continuous casting machines, the amount of molten metal used in one cycle of casting is large at 100 to 200 tons, and an immense damage is incurred if such a large amount of molten metal is discarded due to the above-described reasons.

Japanese Patent Unexamined Publication No. 56-144805 discloses rolling facilities in which a continuous casting machine and a rolling machine are directly coupled with each other, and which employs a technique in which, when trouble, such as damage to a roll, occurs in a group of rolling stands, the operation is backed up by other normal rolling stands and the normal operation is continued without using the faulty rolling stand. However, the group of rolling machine stands disclosed therein are merely arranged as a group of rolling machines requiring a multiplicity of rolling machines, the arrangement being no different from a conventional one in which both a hot rolling machine and a cold rolling machine are disposed with a cooling apparatus interposed therebetween. As a result, they do not serve the originally intended purposes of the continuous casting-directly-coupled rolling facilities in which high-temperature slabs produced continuously are rolled into final products by a group of rolling machines on a small number of stands.

SUMMARY OF THE INVENTION

Accordingly, an object of the present invention is to provide a method of and an apparatus for directly rolling high-temperature slabs produced continuously using facilities in which a continuous casting machine and a rolling machine are directly coupled with each other, and which are capable of effecting an operation without stopping the continuous casting machine even when a failure has occurred in a machine disposed downstream of the continuous casting machine; and of minimizing an amount of wasting of the slabs after the failure of the machine is rectified, thereby overcoming the above-described drawbacks of the prior art.

To this end, according to one aspect of the present invention, there is provided a method of effecting rolling directly coupled with continuous casting for rolling, by a rolling machine for a high-temperature slab produced from a continuous casting machine, comprising the steps of: shearing the slab continuously produced by the continuous casting machine, on the upstream side of the rolling machine, when the operation of machines, including the rolling machine, disposed downstream of the continuous casting machine is stopped; coiling the sheared slab to take up all the slab produced by the continuous casting machine; uncoiling the coiled slab after the restarting of the operation of the machines shut down; and supplying the uncoiled slab to the machines and effecting a rolling operation with respect to the slab.

According to another aspect of the present invention, there is provided a continuous casting-directly-coupled rolling apparatus for rolling by a rolling machine for a high-temperature slab produced by a continuous casting machine directly coupled with the rolling machine, comprising: first and second shearing machines disposed consecutively between the continuous casting machine and a rolling machine located downstream of the continuous casting machine; a coiler and an uncoiler disposed between the shearing machines, the former being adapted to take up a following slab sheared by the first shearing machine, the latter being adapted to uncoil the coiled slab; and an advancing direction changing device adapted to change the advancing direction of the slab sheared by the first shearing machine from a pass line in the direction of the coiler and the uncoiler.

Since, when the operation of machines, including the rolling machine, disposed downstream of the continuous casting machine is stopped, the slab continuously produced from the continuous casting machine is sheared on the upstream side of the rolling machine, the sheared slab is coiled to take up all the slab produced from the continuous casting machine, the coiled slab is uncoiled after the restarting of the operation of the machines shut down, the uncoiled slab is supplied to the machines and a rolling operation is effected with respect to the slab thereby the continuous casting-directly-coupled rolling apparatus operates advantageously as described below.

(1) When the surface of a roll of the rolling machine has become rough, and urgent replacement is necessary:

In such cases, this operation is performed most frequently. In such a case, the slab is sheared by the shearing machine disposed immediately after the continuous casting machine. The slab located downstream of the shearing machine is supplied to the rolling machine. Even after shearing, production is continued without stopping the continuous casting machine, and this slab is taken up by the coiler. After it is taken up to a predetermined length, the slab is sheared by the shearing machine located immediately after the continuous casting machine. The coil taken up is promptly transferred to a furnace for heat-insulating and holding coils. In the meantime, casting is continued, and the on-going slab is coiled again by the coiler. The size of the coil is approximately 15 to 40 tons. This operation is continued, and after all the molten metal prepared for the continuous casting machine is cast, the continuous casting machine is stopped.

Subsequently, after the mill roll in question is recovered, the coils are removed from the furnace for heat-insulating and holding the coils, unwound by the uncoiler. Rolling is then effected to produce rolled products.

In the above-described operation, molten metal prepared for the continuous casting machine can be made into products without any waste.

(2) When a machine disposed downstream of the continuous casting machine has broken down:

In this case, the slab is sheared simultaneously by a shearing machine disposed upstream of the coiler and another disposed downstream of the uncoiler, and the sheared slab placed between the two shearing machines is sheared to predetermined lengths by the downstream shearing machine and is accommodated.

In the meantime, the casting operation is continued, and coiling is performed in the same way as described in item (1). In addition, with respect to the method of uncoiling and rolling after rectification of the failure, the same processing as that described in item (1) above is performed. In this case, only the slabs sheared by the two shearing machines are not made into rolled products, and remain as slabs cut to a predetermined size. However, this results in only a small decline in production yield.

The frequency of occurrence of failure such as those described in item (2) above is small, and, as for the remaining molten metal in this case, the shearing machine disposed downstream of the uncoiler may be omitted, if necessary.

Figure 1:
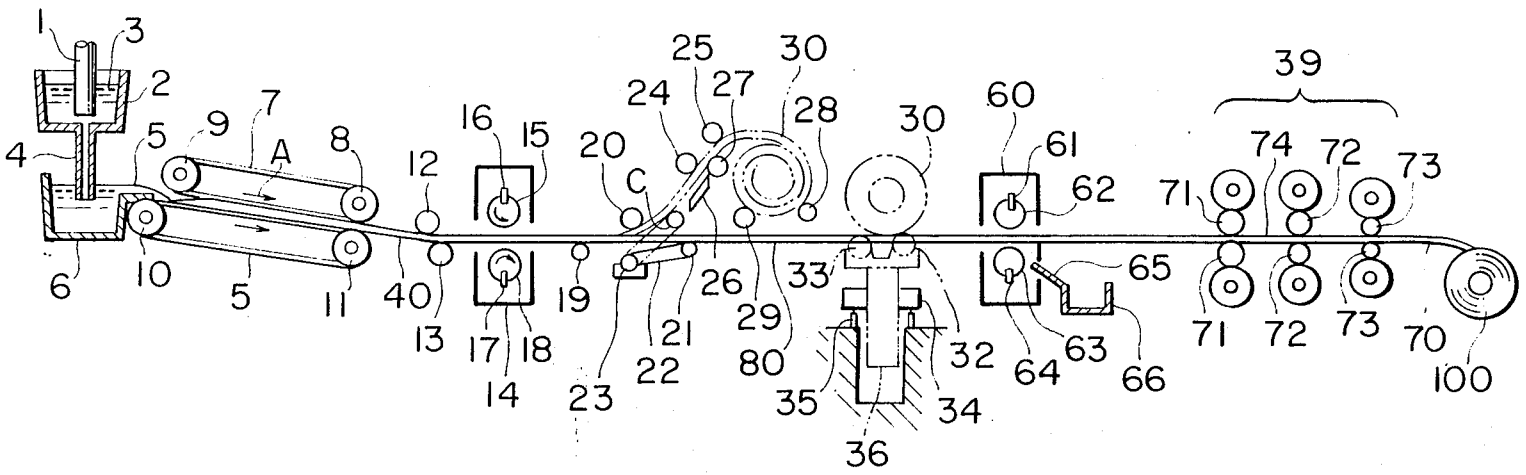
FIG. 1 is an overall schematic diagram of continuous casting-directly-coupled rolling facilities in accordance with an embodiment of the present invention.

DETAILED DESCRIPTION OF THE PREFERRED EMBODIMENTS:

Referring now to FIG. 1, description will be given to a preferred embodiment of the present invention. When rolling is effected directly without shearing a continuously cast slab using a continuous casting machine and a rolling machine, a high-speed thin-slab continuous casting machine is generally employed as the casting machine.

As for dimensions of a section of a thin slab, the thickness is about 10 to 40 mm and the width is about 600 to 1,600 mm, while the casting speed is 10 to 25 m/min or thereabout.

As for the type of continuous casting machine, various types of machines can be used, including a double Publication No. 60-87903, a double belt-type bending continuous casting machine shown in Japanese Patent Unexamined Publication No. 58-110161, and a throttling-type double-belt continuous casting machine shown in Japanese Patent Unexamined Publication No. 58-218349.

The embodiment shown in FIG. 1 illustrates a case in which an inclined-type double-belt continuous casting machine is used. In the double-belt continuous casting machine, a mold is formed by two belts 5, 7 respectively guided by two guide rollers 8, 9, 10, 11. Molten metal 5 is poured into this mold after a stopper 1 is opened and molten metal 3 is transferred to a turn ladle 6 through a nozzle 4. As the belts 5, 7 are rotated in the direction of the arrows A, a slab 40 is produced continuously. This slab 40 is bent into a horizontal shape by means of two bending rollers 12, 13, and is normally sent to a group of rolling machines 39 so as to be reduced and rolled into a predetermined thickness. A hot-rolled sheet product 70 is thereby obtained, and is taken up by a coiler 100. The thickness of this product is approximately 1.6 to 6 mm.

The number of stands in the group of rolling machines is three to five, and surface roughening or surface defects of mill rolls 71, 72, 73 which directly roll a material 74 to be rolled is liable to occur in these rolling machines.

When such trouble occurs in the roll, the surface quality of the product is impaired and cannot be sold as it is as a commercial product, so that it is necessary to stop the operation promptly and replace the roll with a new one.

In such a case, while casting is being continued, the slab 40 is sheared by a shearing machine provided immediately after the continuous casting machine. The leading slab sheared is rolled by the rolling machines at an accelerated speed, so that an interval will be secured between the leading slab and the following slab.

The shearing of the slab is effected by blades 16, 17 which are installed on the rotational shafts 15, 18 housed inside a frame 14 as the rotational shafts 15, 18 are rotated in the directions of the arrows shown in FIG. 1.

The following slab thus sheared is bent upwardly as a bending roller 21 installed on an arm 22 is moved upwardly to the position shown by an alternate long and two-short-dash line when an arm 22 is rotated with a fulcrum 23 as a center relative to two bending rollers 19, 20. Subsequently, this slab is guided by a guide 26, is bent by three bending rollers 24, 25, 27 and is taken up into a coil 30 indicated by the alternate long and two short dashes line. During the coiling, the coil 30 is supported by coil support rollers 28, 29. The machine which performs the above-described coiling operation is called a coiler.

After the slab is taken up into a predetermined coil length, while casting is being continued again, the slab is sheared by the shearing machine disposed immediately after the casting machine. After the shearing, the coiling speed of the coiler with respect to the leading slab increases so that an interval will be secured between the forward end of the following slab and the rear end of the leading slab. Before the forward end of the following slab reaches the three bending rollers 24, 25, 27, the coil 30 whose coiling has been completed is loaded on cradle rollers 32, 33 of a coil car by means of a crane (not shown) on standby, a coil coveying swing arm, or the like. It goes without saying that, during this operation, a slab 80 indicated by the solid lines has already been provided with rolling and is therefore no longer present in this portion.

Figure 3:
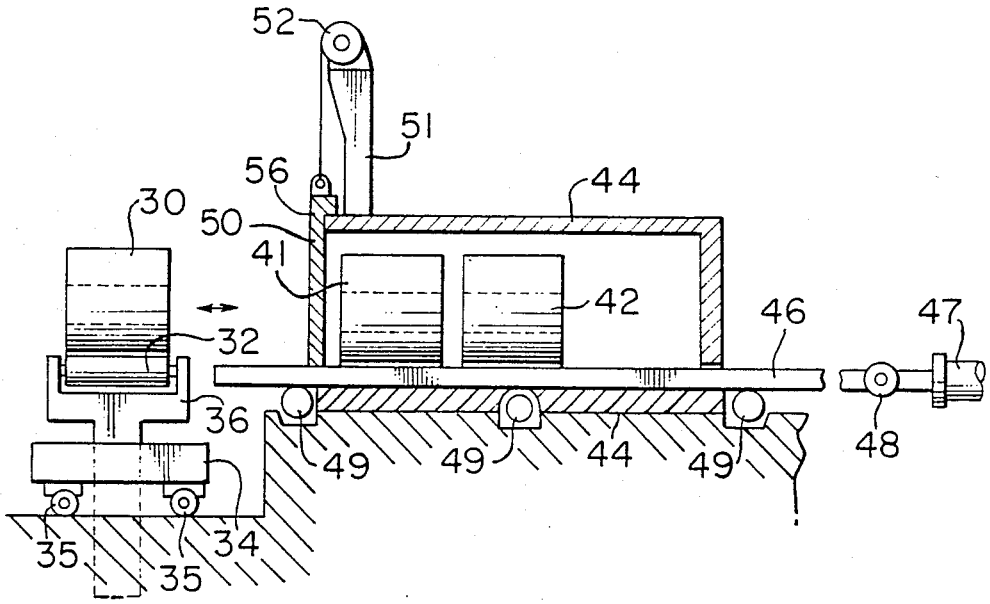
FIG. 3 is a front elevational view illustrating a section for transversely conveying coils in the coiler and the uncoiler.

An operating method of conveying the coil 30 on the coil car to the heat insulating furnace will be described with reference to FIG. 3 which is a front elevational view of a coil conveying section.

The coil car comprises the two cradle rollers 32, 33 as well as a car 34 detachably supporting these cradle rollers 32, 33 and supporting a liftable frame 36. This car 34 is movable back and forth in the direction of the arrows, using wheels 35.

The coil car is moved in the direction of a heat insulation furnace 44, and the coil 30 is placed on a coil conveying beam 46. A wire crane 52 supported by a column 51 is operated to lift a door 50 located in front of a coil heat-insulating furnace 44. Subsequently, a cylinder 47 coupled with the coil conveying beam 46 by means of a pin 48 is retracted, and the coil 30 is stored in the heat insulating furnace 44. Incidentally, the coil conveying beam 46 is supported by a multiplicity of guide rollers 49 so as to facilitate its movement.

Figure 2:
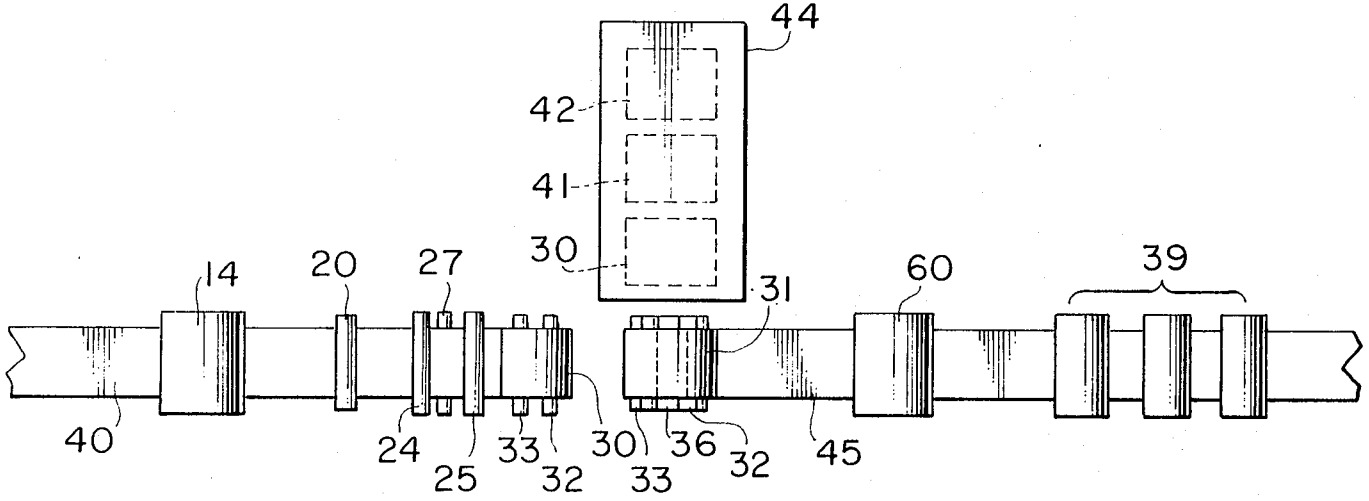
FIG. 2 is a schematic top plan view of an arrangement of a coiler, an uncoiler, and their peripheral equipment shown in FIG. 1.

The state of storage of the coils is shown in FIG. 2 which is a cross-sectional view. In terms of the state of storage of the coils inside the heat insulating furnace 44, the coil 30 which is closest to the side of the coil car is the one which has been delivered last.

Incidentally, although, in FIG. 2, the number of coils in the heat insulating furnace is set to three, a greater number of coils can be stored if the heat insulating furnace is enlarged, as necessary.

In addition, heating energy may be provided to the heat insulating furnace by a burner, for example, to compensate for a drop in the temperature of the coils.

The above-described operation is continued until casting of all the molten metal in the ladle 2 shown in FIG. 1 is completed.

By the time when casting is completed, the replacement of a mill roll is usually completed. Namely, the roll replacement takes 10 minutes or thereabout, whereas 30 to 60 minutes is required in casting 100 tons.

Upon completion of casting, the coil 30 is returned to the cradle rollers 32, 33 in the reverse order of that of the above-described coil storing operation. The cradle rollers are rotated, the coil 30 is uncoiled, and the slab is delivered to the group of rolling machines 39 to effect rolling. This uncoiling operation is effected by the coil car which also serves to convey the coil.

When a machine disposed downstream of the continuous casting machine, particularly one disposed downstream of the rolling machines, breaks down, and the machines are to be stopped, a shearing machine disposed downstream of the uncoiler and a shearing machine disposed immediately after the continuous casting machine are operated simultaneously to shear the slab 80. Specifically, the slab 80 which is present between the two shearing machines is sheared to a predetermined length by blades 61, 64 installed on rotary shafts 62, 63 which are housed in a frame 60 when the rotary shafts 62, 63 are rotated.

The slab sheared to the predetermined length is stored in a bucket 66 through a chute 65. Casting is continued during this time, and the rear end of the slab sheared by the shearing machine disposed immediately after the casting machine is taken up into a coil in the same way as during the above-described replacement of the mill roll and is stored in the heat insulating furnace 44. In addition, after the faulty machine is repaired, the slab is uncoiled and rolled.

Figure 5:
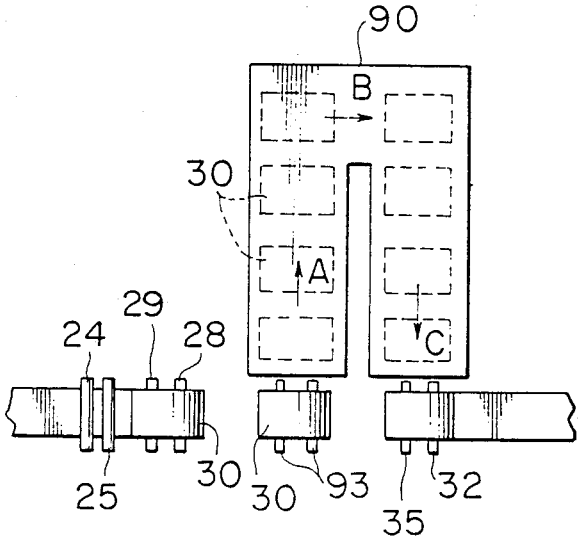
FIG. 5 is a schematic top plan view of the section for transversely conveying the coils in the coiler and the uncoiler shown in FIG. 4.
Figure 4:
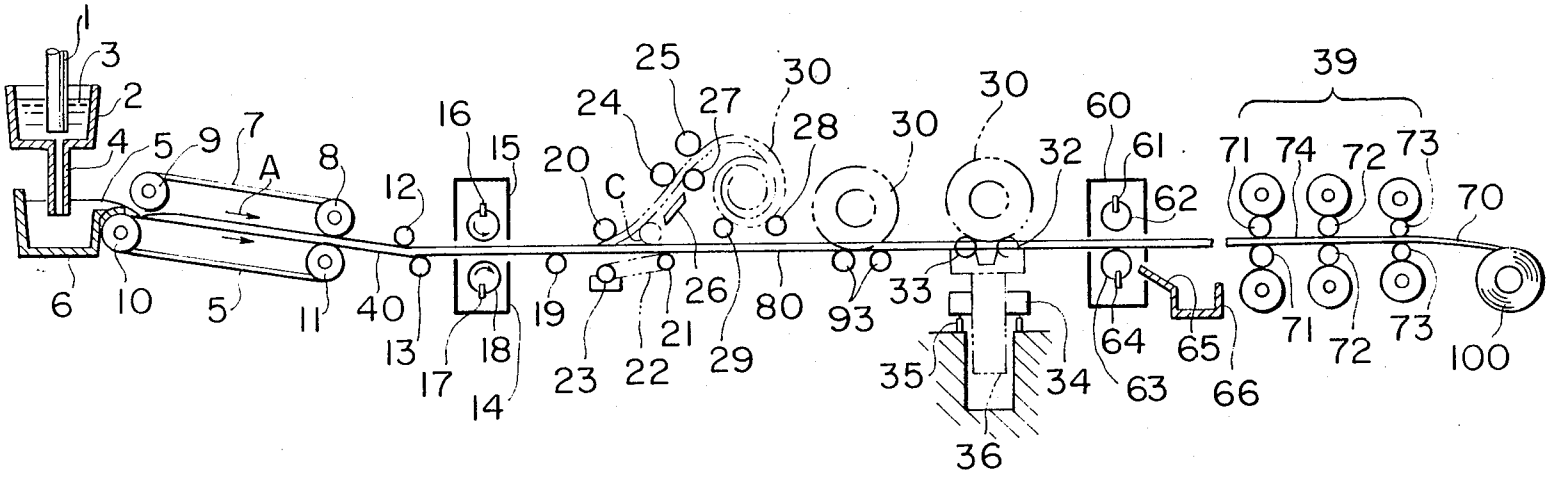
FIG. 4 is an overall schematic diagram of the continuous casting-directly-coupled rolling facilities in accordance with another embodiment of the present invention.

It should be noted that, in FIG. 2, the coils 30, 41, 42 accommodated in the heat insulation furnace 44 are sent to the uncoiler in the reverse order of that at the time of their accommodation, and the waiting time of each coil in the heat insulating furnace 44 is not uniform. For this reason, in another embodiment of the present invention shown in FIG. 4, an arrangement is provided to overcome the above-described drawback. Incidentally, with reference to FIG. 4, a description will be omitted with respect to arrangements that are identical with those shown in FIG. 1, and a description will be given only with respect to the differences there between. Namely, as shown in FIG. 4, intermediate coil support rollers 93 are provided between the coiler and the uncoiler, and the coil for which coiling has been completed by the coiler is placed thereon, and is subsequently stored in a heat insulating furnace 90 shown in FIG. 5, thereby overcoming the above-described drawback.

Namely, in the heat insulating furnace 90, the coils 30 are adapted to move in the direction of the arrow A, then in the direction of the arrow B, and further in the direction of the arrow C, and is supplied to the uncoiler. As a result, the waiting time of the coils inside the heat insulating furnace 90 becomes substantially uniform In accordance with the embodiments of the present invention, the following advantages can be obtained:

In other words, in an arrangement in which a continuous casting machine and a rolling machine are arranged in series and a cast slab is normally rolled directly by the rolling machine without being sheared, even in cases where the machines disposed downstream of the continuous casting machine have to be stopped owing to the breakdown of a machine disposed downstream of the continuous casting machine or for another unavoidable reason, it is possible to cast all molten metal prepared for the continuous casting machine without stopping the continuous casting machine. The slab formed by casting is taken up into a coil and is reduced into a shape that gives a small surface area and, hence, a small amount of heat dissipation. This coil is stored in the heat insulating furnace in an isolated state. Therefore, the casting heat is practically not lost, and in conjunction with the restarting of the machines downstream of the continuous casting machine, these coils are uncoiled and can be made into products. In addition, since the large amount of molten metal remaining in the ladle can be made into products by applying the present invention, a substantial improvement can be made in the yield of production.

In addition, such an arrangement is also advantageous when those steel types are handled that would be cracked if they are rolled immediately after casting, as in the case of special products including high alloy steel. In other words, ordinary products are directly rolled, whereas special products are temporarily coiled and are stored in a heat insulating furnace for a predetermined time, and are then taken out and rolled, thereby making it possible to effect the operation selectively. While the coils are held in the heat insulating furnace for a predetermined time, the alloy products undergo homogeneous diffusion, so that cracking will not occur even if they are rolled.

In accordance with the present invention, there is an advantage in that it is possible to provide a continuous casting-directly-coupled rolling apparatus of practical use in which a continuous casting machine and a rolling machine are coupled with each other and a high-temperature slab produced continuously by the continuous casting machine is directly rolled, and which, even if a malfunctioning occurs in a machine disposed downstream of the continuous casting machine, is capable of effecting the operation without stopping the operation of the continuous casting machine. Even after the overcoming of the malfunctioning of said machine, it is possible to minimize the amount of the slab being wasted.

What is claimed is:

1. A direct coupling type continuous cast rolling method of rolling, through a rolling line including a rolling machine and other various machines, a high-temperature sheet slab produced from a continuous casting line arranged upstream of said rolling line and including a continuous casting machine, comprising the steps of:

providing said continuous casting line in one common linear row with said rolling line so that said sheet slat continuously produced from said casting line is led directly to said rolling line so as to roll the sheet slab in normal operation;

shearing said slab as it is being continuously produced by said continuous casting machine, on the upstream side of said rolling machine, when the operation of any one of the machines including said rolling machine, disposed downstream of said continuous casting machine is stopped;

coiling said sheared slab to take up all of the slab produced by said continuous casting machine;

uncoiling said coiled slab after the restarting of the operation of said one of the machines shut down; and supplying said uncoiled slab to said rolling line and effecting a rolling operation with respect to said slab.

2. A direct coupling type continuous cast rolling method of rolling, through a rolling line including a rolling machine and other various machines, a high-temperature sheet slab produced from a continuous casting line arranged upstream of said rolling line and including a continuous casting machine, comprising the steps of:

providing said continuous casting line in one common linear row with said rolling line so that said sheet slab is continuously produced from said casting line and led directly to said rolling line so as to roll the sheet slab during normal operation with said rolling machine which is disposed downstream of said continuous casting machine;

shearing said slab as it is being produced and supplied continuously by said continuous casting machine, at a position upstream of said rolling machine, when the operation of said rolling machine is stopped;

coiling said sheared slab including continuing said coiling until the end of said slab produced by said continuous casting machine is taken up;

holding said coiled slab in a high-temperature state;

uncoiling said coiled slab after said rolling machine is restarted; and supplying said uncoiled slab to said machines for resuming the rolling operation.

3. A direct coupling type continuous cast rolling method of rolling, through a rolling line including a rolling machine and other various machines, a high-temperature sheet slab produced from a continuous casting line arranged upstream of said rolling line and including a continuous casting machine, comprising the steps of:

providing said continuous casting line in one common linear row with said rolling line so that said sheet slab continuously produced from said casting line is led directly to said rolling line so as to roll the sheet slab during normal operation with said rolling machine, which is disposed downstream of said continuous casting machine;

shearing said high temperature slab as it is being continuously produced by said continuous casting machine at a position upstream of said rolling machine, when a malfunctioning has occurred in said rolling machine to divide said slab into leading and following slabs said continuous casting machine;

supplying the leading slab to said rolling machine to continue a rolling operation, while coiling the following slab;

uncoiling said coiled slab when the malfunctioning of said rolling machine is overcome; and supplying said uncoiled slab to said rolling machine to effect the rolling operation.

4. A direct coupling type continuous cast rolling method of rolling through a rolling line, including a rolling machine and other various machines, a high-temperature sheet slab produced from a continuous casting line arranged upstream of said rolling line and including a continuous casting machine, comprising the steps of:

providing said continuous casting line in one common linear row with said rolling line so that said sheet slab continuously produced from said casting line is led directly to said rolling line so as to roll the sheet slab during normal operation with said rolling machine, which is downstream of said continuous casting machines, shearing said high-temperature slab as it is being continuously produced by said continuous casting machine at two positions upstream of said rolling machine, when a malfunction has occurred in said rolling machine to divide said slab into leading and following slabs;

delivering the following slab to a side of the rolling line while coiling the following slab at a high-temperature state;

uncoiling said coiled slab when said malfunction of said rolling machine is overcome; and supplying said uncoiled slab to said rolling machine and to effect a rolling operation.

5. A direct coupling type continuous cast rolling apparatus for rolling, through a rolling line including a rolling machine, a high-temperature sheet slab produced from a continuous casting line including a continuous casting machine, comprising:

said continuous casting machine and said rolling machine being coupled together so that said rolling line and said continuous casting line are laid in one common linear row, first and second shearing machines disposed consecutively between said continuous casting machine and said rolling machine, said rolling machine being located downstream of said continuous casting machine;

coiling means and uncoiling means disposed between said shearing machines for taking up a following slab sheared by said first shearing machine and for uncoiling said coiled slab respectively; and means for changing an advancing direction of said slab sheared by said first shearing machine from a pass line in the direction of said coiling and uncoiling means.

6. A direct coupling type continuous cast rolling apparatus according to claim 5, further comprising a heat insulating device for maintaining at a high-temperature state said slab taken up by said coiling means.

* * * * *